US006841122B2

(12) United States Patent
Kayano et al.

(10) Patent No.: US 6,841,122 B2
(45) Date of Patent: Jan. 11, 2005

(54) HOT WORKING DIE STEEL EXCELLING IN MOLTEN CORROSION RESISTANCE AND STRENGTH AT ELEVATED TEMPERATURE AND MEMBER FOR HIGH TEMPERATURE USE FORMED OF THE HOT WORKING DIE STEEL

(75) Inventors: Rinzo Kayano, Muroran (JP); Eiji Maeda, Muroran (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 10/133,467

(22) Filed: Apr. 29, 2002

(65) Prior Publication Data

US 2002/0182099 A1 Dec. 5, 2002

(30) Foreign Application Priority Data

May 1, 2001 (JP) ..... P2001-133945

(51) Int. Cl.[7] ..... C22C 38/30; C22C 38/32; C22C 38/22

(52) U.S. Cl. ..... 420/36; 420/37; 420/38; 420/67; 420/114; 420/107; 148/318; 148/319; 148/328; 148/326

(58) Field of Search ..... 420/36–38, 61, 420/107, 114, 67, 69; 148/318, 319, 326, 328, 325, 330, 333

(56) References Cited

U.S. PATENT DOCUMENTS 6,117,388 A * 9/2000 Shibata et al. ..... 420/37
6,379,475 B1 * 4/2002 Kuehmann ..... 148/319
6,491,767 B1 * 12/2002 Kuehmann ..... 148/318

* cited by examiner

*Primary Examiner*—Deborah Yee
(74) *Attorney, Agent, or Firm*—Sughrue Mion, PLLC

(57) ABSTRACT

A hot working die steel contains 0.05–0.25% C, 0.30% or less Si, 0.03% or less Mn, 1.0% or less Ni, 5.0–13.0 % Cr, 2.0% or less Mo, 1.0–8.0% W, 1.0–10.0% Co, 0.003–0.020% B, 0.005–0.050% N, and the balance consisting essentially of Fe and unavoidable impurities. If desired, the hot working die steel may further contain 0.01–1.0% V and 0.01–1.0% of at least one kind selected from Nb and Ta.

11 Claims, 3 Drawing Sheets

HOT WORKING DIE STEEL EXCELLING IN MOLTEN CORROSION RESISTANCE AND STRENGTH AT ELEVATED TEMPERATURE AND MEMBER FOR HIGH TEMPERATURE USE FORMED OF THE HOT WORKING DIE STEEL

BACKGROUND OF THE INVENTION

1. Field of the Invention

The present invention relates to a hot working die steel which is used in the state of relatively high temperatures (suitably 300° C. or more) and a member for high temperature use such as a structural member for a casting machine, a structural member for an injection molding machine, and a member for a hot forging machine which are made of the hot working die steel.

The present application is based on Japanese Patent Application No. 2001-133945, the entire contents of which are incorporated herein by reference.

2. Description of Related Art

As a structural member for a casting machine which is exposed to high temperatures when aluminum, magnesium, or an alloy having them as principal components is fabricated by casting, a hot working die steel such as 5% Cr-based JIS (Japanese Industrial Standards)-SKD 61 steel has been conventionally adopted. In addition, the JIS-SKD 61 steel has similarly been adopted as a structural member for an injection molding machine for such a light metal or a low melting metal.

In the cases where the JIS-SKD 61 steel is used for such applications, its life expires due to various factors, and as one factor it is possible to cite the shortage of creep rupture ductility and an increase in the creep strain occurring when the JIS-SKD 61 steel is used for extended periods of time in an environment in which stresses are applied at elevate temperatures. This is because although, in the JIS-SKD 61 steel, an attempt is made to reinforce it by allowing carbides to precipitate in the martensite in the form of very fine particles by tempering, if it is used for extended periods of time at evaluated temperature, the recovery of the dislocation and the coagulation and coarsening of carbides occur, so that the initial material property cannot be maintained, and the JIS-SKD 61 steel gradually softens. Furthermore, in such as an injection machine which is heated to high temperatures, there emerges the risk that the JIS-SKD 61 steel is subjected to abrasive scoring and is liable to be broken in the process in which a shearing force is imparted to a solid alloy and the solid alloy is melted.

Meanwhile, a Ni-base superalloy such as Inconel 718 (trade name, hereinafter the same) is known as materials excelling in the strength at elevated temperatures. However, this material has a problem in that its corrosion is noticeable due to the molten aluminum, magnesium, or alloy having them as principal components. Furthermore, when the structural member is heated by a heater or the like to melt aluminum, magnesium, or an alloy having them as principal components, the Ni-base superalloy such as Inconel 718 is poor in thermal conductivity and low in ductility and toughness at high temperatures. Hence, there have been problems in that thermal stresses attributable to a temperature difference between inner and outer surfaces of the member occur, and that the material deteriorates and the reliability as the structural member declines. In addition, although it is known that Stellite (trade name, hereinafter the same), which is generally used as a tool material and a valve material, and other cobalt-base alloys, are materials excellent in the strength at elevated temperatures and that their quantity of molten corrosion is small, these metals have a problem in that they are difficult to use as structural members since their toughness is slightly inferior and they are expensive.

SUMMARY OF THE INVENTION

The object of the invention is to provide a highly reliable hot working die steel which overcomes the above-described problems, as compared with the conventional JIS-SKD 61 steel, has a high high-temperature creep strength and an equivalent short-time tensile strength, excels in a corrosion resistance with respect to the molten aluminum, magnesium, or alloy having them as principal components, and is capable of suppressing the generation of thermal stresses attributable to a temperature difference in the member due to the fact that it has satisfactory thermal conductivity, as well as a member for high temperature use formed of that hot working die steel.

(1) In the invention for overcoming the above-described problems, there is provided a hot working die steel excelling in molten corrosion resistance and strength at elevated temperature comprising: 0.05–0.25% by mass of C, 0.30% by mass or less of Si, 0.30% by mass or less of Mn, 1.0% by mass or less of Ni, 5.0 to 13.0% by mass of Cr, 2.0% by mass or less of Mo, 1.0 to 8.0% by mass of W, 1.0 to 10.0% by mass of Co, 0.003 to 0.020% by mass of B, 0.005 to 0.050% by mass of N, and the balance including Fe and unavoidable impurities.

(2) In the invention of the hot working die steel excelling in molten corrosion resistance and strength at elevated temperature, the invention is characterized by further comprising 0.01 to 1.0% by mass of V as a constituent.

(3) In the invention of the hot working die steel excelling in molten corrosion resistance and strength at elevated temperature, the invention is characterized by further comprising by mass percent 0.01 to 1.0% by mass of at least one kind selected from Nb and Ta as a constituent.

(4) In the invention of the hot working die steel excelling in molten corrosion resistance and strength at elevated temperature, the invention is characterized in that the total content of Co and W is 5.0% by mass or more.

(5) In the invention of the hot working die steel excelling in molten corrosion resistance and strength at elevated temperature, the invention is characterized in that a value of a Cr equivalent expressed by the following formula is 7.0 or less:

$$\text{Cr equivalent}=[\text{Cr }\%]+6[\text{Si }\%]+4[\text{Mo }\%]+1.5[\text{W }\%]+11[\text{V }\%]+5[\text{Nb }\%]-40[\text{C }\%]-2[\text{Mn }\%]-4[\text{Ni }\%]-30[\text{N }\%]-2[\text{Co }\%]$$

(6) A member for high temperature use formed of a hot working die steel based on the present invention is characterized in that the member constitutes a structural member for a casting machine, a structural member for an injection molding machine, or a member for a hot forging machine.

(7) In the invention of the member for high temperature use formed of a hot working die steel, the invention is characterized in that surface hardening is performed at least for a portion of surfaces of the member.

(8) In the invention of the member for high temperature use formed of a hot working die steel, the invention is characterized in that the surface hardening is effected by one of nitriding, carbonization, and ion implantation.

Namely, by virtue of the above-described composition, the hot working die steel of the invention has a high short-time tensile strength and a high-temperature creep strength, exhibits an excellent corrosion resistance with respect to a molten aluminum alloy or the like, and has satisfactory thermal conductivity. Owing to the aforementioned characteristic, the member for high temperature use using the hot working die steel of the invention, when used in the high-temperature environment, exhibits excellent durability, and yields higher reliability.

Figure 1:
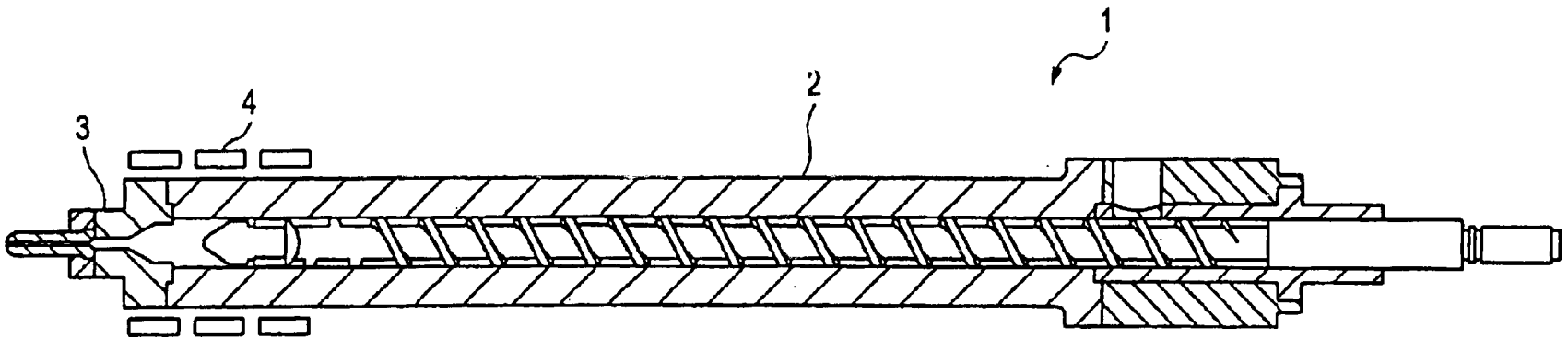
FIG. 1 is a cross-sectional view illustrating an injection molding machine in accordance with an embodiment of the invention.

A description will be given of the reasons for limiting the components which are defined in the invention as well as the operation thereof. It should be noted the following contents are respectively shown in mass percent.

C: 0.05–0.25%

C is an element which is dissolved in the matrix and promotes the martensitic transformation, and is an indispensable element for ensuring hardenability. At the same time, C forms carbides by combining with Fe, Cr, Mo, W, V, Nb, and the like, and is an indispensable element for enhancing the strength at elevated temperature. Namely, in other words, C is an essential element for ensuring the strength, hardness, wear resistance, and the like which are minimum requirements as a member for high temperature use. To allow its effects to be demonstrated, a content of not less than 0.05% at minimum is required. However, since an excessive content is likely to lead to the excessive coarsening of carbides and results in the lowering of the strength at elevated temperature, an upper limit is set to 0.25%. It should be noted that it is more preferable to set the lower limit to 0.07% and the upper limit to 0.15% for the same reasons.

Si: 0.30% or less

Si is used as a deoxidizing element when steels are melted and refined, with the result that the steel unavoidably contains Si as an impurity. However, Si promotes the coarsening of the carbides, and forms intermetallic compounds called Laves phase, causing the toughness of the steel to decline. Accordingly, it is preferable to lower the Si content as much as possible, and the Si content is limited to 0.30% or less. It should be noted that it is more preferable to limit the Si content to 0.20% or less.

Mn: 0.30% or less

Mn is a useful element as a deoxidizing element in the same as Si, and contributes to the improvement of hardenability. However, an excessive addition leads to the deterioration of toughness and causes the strength at elevated temperature to decline. Accordingly, its content is limited to 0.30% or less. It should be noted that it is more preferable to limit the Mn content to 0.20% or less.

Ni: 1.0% or less

Ni is a useful element for enhancing hardenability and suppressing the formation of δ ferrite, and is actively contained as desired. However, an excessive content causes the molten corrosion resistance to decline. Accordingly, its content is limited to 1.0% or less. Although there are cases where Ni is contained as an unavoidable impurity, in cases where it is actively contained, it is preferable to contain 0.2% or more to sufficiently obtain the above-described effects.

Cr: 5.0–13.0%

Cr is a necessary and indispensable additional element as a member for high temperature use in order to ensure oxidation resistance and high-temperature corrosion resistance and enhance the strength of the alloy by forming carbides by combining with C. Further, since its stability against a molten metal is high, Cr improves the molten corrosion resistance of the alloy. To allow its effects to be demonstrated, a content of not less than 5.0% at minimum is required. However, an excessive content promotes the formation of δ ferrite, and leads to a decline in toughness and a decrease in the strength at elevated temperature. Accordingly, its content is limited to the range of 5.0–13.0%. It should be noted that it is more preferable to set the lower limit to 8.0% and the upper limit to 11.0% for the same reasons.

Mo: 2.0% or less

Mo is dissolved in the matrix and has the effects of improving the strength at elevated temperature, promoting the precipitation of very fine carbides, and preventing their coagulation. In addition, since its stability against a molten metal is high, Mo improves the molten corrosion resistance of the alloy, so that it is contained as desired. However, an excessive content promotes the formation of δ ferrite, and leads to the deterioration of the toughness and a decrease in the strength at elevated temperature. Accordingly, its content is limited to 2.0% or less. It should be noted that it is more preferable to set the upper limit to 1.0% for the same reasons. Further, to obtain the aforementioned effects sufficiently, it is preferable to contain 0.2% or more.

W: 1.0–8.0%

W is dissolved in the matrix and has the effects of improving the strength at elevated temperature and preventing the coagulation of carbides. In addition, since its stability against a molten metal is high, W improves the molten corrosion resistance of the alloy. However, since its effect is greater than that of Mo, it is required that W be contained necessarily. To allow its effects to be demonstrated, a content of not less than 1.0% at minimum is required. However, since an excessive content promotes the formation of δ ferrite and the Laves phase, it leads to the toughness degradation and a decrease in the strength at elevated temperature. Accordingly, its content is limited to the range of 1.0–8.0%. It should be noted that it is more preferable to set the lower limit to 3.0% and the upper limit to 6.0% for the same reasons.

V: 0.01–1.0%

V forms carbides by combining with C, and contributes to the improvement of the strength at elevated temperature and the wear resistance, so that it is contained as desired. To allow its effects to be demonstrated, a content of not less than 0.01% at minimum is required. However, since an excessive content is likely to lead to the excessive coarsening of carbides and results in the lowering of the strength at elevated temperature to the contrary, its content is limited to the range of 0.01–1.0%. It should be noted that it is more preferable to set the lower limit to 0.10% and the upper limit to 0.40% for the same reasons.

Nb+Ta: 0.01–1.0%

Nb and Ta form very fine carbides by combining with C, and contribute to the improvement of the strength at elevated temperature and the refinement of grains, so that one or both of Nb and Ta are contained as desired. To allow their effects to be demonstrated, a content of not less than 0.01% at minimum is required. However, since an excessive content is likely to lead to the excessive coarsening of carbides and results in the lowering of the strength at elevated temperature and a decline in toughness to the contrary, its content is limited to the range of 0.01–1.0% in total. It should be noted that it is more preferable to set the lower limit to 0.02% and the upper limit to 0.15% for the same reasons.

Co: 1.0–10.0%

Co is solidly dissolved in the matrix and improves the strength at elevated temperature and impact toughness. In addition, Co suppresses the formation of δ ferrite and prevents degradation in the strength at elevated temperatures and toughness. Accordingly, it is required that Co be added necessarily, and to allow its effects, a content of 1.0% at minimum is required. However, since Co is a very expensive element, an excessive addition makes the cost of the alloy remarkably high. Accordingly, its content is limited to the range of 1.0–10.0%. It should be noted that it is more preferable to set the lower limit to 3.0% and the upper limit to 6.0% for the same reasons.

Co+W: 5.0% or more

As described above, since Co exerts favorable effects on the strength, toughness, and the molten corrosion resistance at elevated temperatures, it is preferable to further increase the content within the aforementioned limited range so as to further improve these characteristics. However, there are a certain measure of complementary relationship between W and Co which exhibit similar effects, and part of Co which is an expensive alloy element maybe substituted by W. Accordingly, it is desirable to set a total of Co and W content to 5.0% or more.

B: 0.003–0.020%

Even if B is added in a very small amount, B is mainly segregated at grain boundaries and thereby has the effect of stabilizing the grain boundaries. By virtue of this effect, B suppresses a structural time dependent change at elevated temperatures, maintains the strength for extended periods, and suppresses the occurrence or propagation of cracks. To allow its effect to be demonstrated, a content of not less than 0.003% at minimum is required. However, an excessive content leads to degradation in ductility and toughness. Accordingly, its constant is limited to the range of 0.003–0.02%. It should be noted that it is more preferable to set the lower limit to 0.005% and the upper limit to 0.012% for the same reasons.

N: 0.005–0.050%

N forms nitrides or carbonitrides by combining with Cr, V, Nb, and the like in the alloy, and reinforces the matrix. Further, N improves the corrosion resistance and strength at elevated temperatures. To allow its effect to be demonstrated, a content of not less than 0.005% at minimum is required. However, an excessive content leads to the deterioration of the molten corrosion resistance. Accordingly, its content is limited to the range of 0.005–0.05%. It should be noted that it is more preferable to set the lower limit to 0.01% and the upper limit to 0.03% for the same reasons.

Cr equivalent: 7.0 or less

Since the tendency of formation of δ ferrite is enhanced by an increase in the Cr equivalent shown by a formula below, and leads to declines in toughness and the strength at elevated temperature. Accordingly, it is preferable to limit the Cr equivalent to 7.0 or less.

Cr equivalent=[Cr %]+6[Si %]+4[Mo %]+1.5[W %]+11[V %]+5[Nb %]−40[C %]−2[Mn %]−4[Ni %]−30[N %]−2[Co %]

Hereafter, a description will be given of an embodiment of the invention.

A hot working die steel in accordance with the invention can be fabricated by melting according to a conventional method after various components are adjusted so as to prepare a predetermined composition. In the invention, its melting process is not particularly restricted.

The hot working die steel obtained as described above has the composition shown above, excels in the short-time tensile strength, the high-temperature creep strength, and the molten corrosion resistance, and has satisfactory thermal conductivity.

The hot working die steel is subjected to appropriate treatment, and is made available as a member for high temperature use. It should be noted that, in the invention, the fabrication process of the hot working die steel to the member for high temperature use is not particularly limited, and rolling, forging, bending, grinding, and other machining may be performed appropriately. A suitable application of the member for high temperature use is an application in which it is used at a high-temperature environment such as 300° C. or more and in which the above-described characteristics are required. For example, as typical applications it is possible to cite a structural member for a casting machine, a structural member for an injection molding machine, and a member for a hot forging machine.

FIG. 1 a cross-sectional view illustrating a part of an injection molding machine 1 which is used in a high-temperature environment, and the hot working die steel in accordance with the invention is used for a cylinder 2 and a cylinder head 3 as members for high temperature use. In addition, a heater 4 for heating a distal end portion of the cylinder 2 and the cylinder head 3 is disposed around a distal end-side outer peripheral portion of the cylinder 2. When the injection molding machine 1 is operated, the cylinder 2 and the cylinder head 3 assume high-temperature states, and in a case where low melting metal is injection molded, a high-temperature low melting metal moves inside the cylinder 2 and the cylinder head 3 while coming into contact therewith. In addition, the distal end portion of the cylinder 2 and the cylinder head 3 are heated by the heater 4 from their outer peripheral sides.

In the above-described operation, the cylinder 2 and the cylinder head 3 which are formed of the hot working die steel excel in the high-temperature characteristics and the molten corrosion resistance, and exhibit outstanding durability even in the aforementioned high-temperature environment. In addition, the cylinder 2 and the cylinder head 3 also excel in thermal conductivity, and the occurrence of thermal stresses due to heating by the heater is small, so that it is possible to obtain high reliability as the apparatus.

In the member for high temperature use in accordance with the invention, surface hardening, although not provided in this embodiment, may be provided for a portion or the whole of its surfaces. By virtue of this surface hardening, it is possible to improve the wear resistance, molten corrosion resistance, and the like of the member for high temperature use. The method of this surface hardening is not particularly restricted in the invention, and it is possible to cite, for example, nitriding processing, carbonization processing, and ion implantation using such as carbon and nitrogen ions.

EXAMPLES

Hereafter, a detailed description will be given of an example of the invention.

Specimens having compositions shown in Table 1 were fabricated into 50 kg steel ingots by melting in a vacuum induction melting furnace. It should be noted that a total of Co and W content (Co+W) and the Cr equivalent of the aforementioned specimens are jointly shown in the table. The respective fabricated steel ingots, after being subjected to diffusion and homogenization treatment, were formed into plates with a thickness of 30 mm and a width of 120 mm by hot forging. Test pieces taken from these plates were subjected to heat treatment for 3 hours at 1100° C. and were then air-cooled as quenching, and were subjected to heat treatment for 20 hours at 670° C. and were then furnace-cooled as tempering.

subjecting the surfaces to nitriding processing were measured by a Vickers hardness test machine, a noticeable increase in hardness in the range of MHV 450 to 700 was noted. Hence, it can be expected that it is possible to ensure wear resistance in sliding portions of such as a cylinder and a screw of an injection molding machine or an extruding machine and improve the molten corrosion resistance further.

Further, with respect to one (No. 1) of the steels of the invention and some (Nos. 11, 12, and 13) of the comparative and conventional steels, the short-time tensile strength and

TABLE 1

Chemical composition of Specimens (Mass %)

| Classification | No. | C | Si | Mn | Ni | Cr | Mo | W | V | Nb + Ta | Co | B | N | Fe | Co + W | Cr equivalent |
|---|---|---|---|---|---|---|---|---|---|---|---|---|---|---|---|---|
| Steels of Invention | 1 | 0.09 | 0.03 | 0.01 | 0.21 | 9.98 | 0.11 | 3.15 | 0.19 | 0.06 | 2.99 | 0.0100 | 0.0200 | balance | 6.1 | 6.68 |
| | 2 | 0.11 | 0.03 | 0.01 | 0.21 | 10.06 | 0.11 | 3.04 | 0.19 | 0.08 | 3.06 | 0.0100 | 0.0190 | balance | 6.1 | 5.78 |
| | 3 | 0.11 | 0.03 | 0.01 | 0.20 | 9.98 | 0.11 | 3.49 | 0.18 | 0.07 | 2.99 | 0.0110 | 0.0190 | balance | 6.5 | 6.40 |
| | 4 | 0.08 | 0.03 | 0.01 | 0.21 | 10.04 | 0.11 | 4.05 | 0.15 | 0.06 | 4.05 | 0.0110 | 0.0180 | balance | 8.1 | 5.99 |
| | 5 | 0.10 | 0.03 | 0.01 | 0.20 | 9.99 | 0.11 | 4.53 | 0.15 | 0.06 | 3.99 | 0.0110 | 0.0200 | balance | 8.5 | 5.96 |
| | 6 | 0.09 | 0.04 | 0.07 | 0.21 | 10.27 | 0.01* | 4.06 | 0.19 | 0.06 | 6.08 | 0.0070 | 0.0250 | balance | 10.1 | 1.54 |
| | 7 | 0.10 | 0.03 | 0.01 | 0.20 | 8.56 | 0.11 | 3.45 | 0.15 | 0.07 | 2.99 | 0.0090 | 0.0200 | balance | 6.4 | 4.96 |
| | 8 | 0.12 | 0.02 | 0.01 | 0.01* | 11.38 | 0.40 | 1.91 | 0.20 | 0.08 | 3.02 | 0.0090 | 0.0270 | balance | 4.9 | 6.86 |
| | 9 | 0.12 | 0.04 | 0.01 | 0.36 | 11.65 | 0.40 | 1.91 | 0.21 | 0.08 | 2.73 | 0.0090 | 0.0160 | balance | 4.6 | 6.87 |
| Comparative Steels | 10 | 0.36 | 0.11 | 0.10 | 0.20 | 8.21 | 1.35 | 0.75 | 0.61 | 0.05 | 0.74 | 0.0110 | 0.0216 | balance | 1.5 | 4.83 |
| | 11 | 0.19 | 0.11 | 0.11 | 0.05 | 9.95 | 1.45 | 3.14 | 0.20 | 0.04 | 7.50 | 0.0005 | 0.0190 | balance | 10.6 | −0.07 |
| Conventional Steels | 12 | 0.37 | 1.06 | 0.37 | 0.10 | 5.26 | 1.32 | — | 0.92 | — | — | 0.0005 | 0.0161 | balance | 0.0 | 10.60 |
| | 13 | 0.02 | 0.08 | 0.02 | 52.49 | 18.01 | 2.89 | — | 0.01 | 4.80 | — | 0.0005 | 0.0093 | balance | 0.0 | — |

*contained as an impurity

Figure 2:
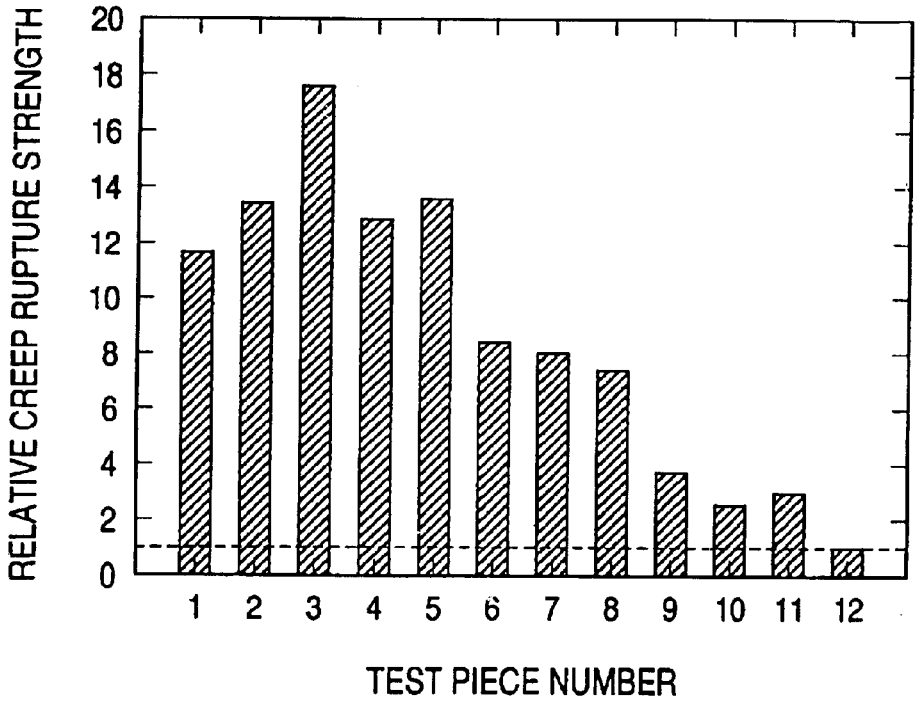
FIG. 2 is a graph illustrating the creep rupture life of each test piece determined from a creep rupture test.

First, to evaluate the creep strength of the test pieces at evaluated temperature, the test pieces after quenching and tempering were subjected to a creep rupture test under the conditions of a temperature of 650° C. and a stress of 157 MPa, and the ratio of their creep rupture life to that of the SKD 61 steel, i.e., a conventional steel, was defined as a relative creep rupture life. FIG. 2 shows the relative creep rupture life of each test piece, and it is clear that the steels of the invention excel in the creep rupture strength over the conventional SKD 61 steel (No. 12) and the comparative steels (Nos. 10 and 11). In addition, FIG. 2 shows that, among the steels of the invention, those (Nos. 1 to 7) in which the amount of (Co+W) exists the range of 5.0% or more exhibit higher creep rupture strength.

Figure 3:
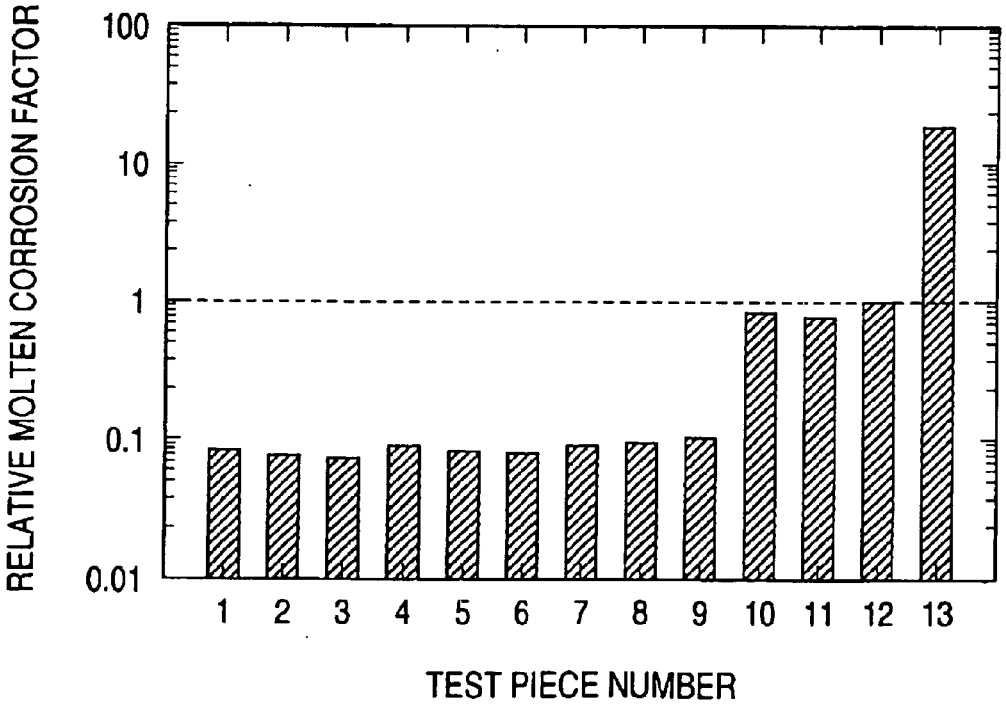
FIG. 3 is a graph illustrating a relative molten corrosion rate factor (the molten corrosion rate constant of each test piece with respect to the molten corrosion rate constant of SKD 61 steel) of each test piece determined from the results of a melting loss test.

Further, to evaluate the molten corrosion resistance of each test piece, a molten corrosion test using a self-fabricated testing machine was carried out. The amount of molten corrosion and a molten corrosion rate constant at 650° C. per 100 hours at maximum were determined while the test pieces were being rotated in a molten Al-Mg alloy. The molten corrosion rate constant of each test piece with respect to the conventional SKD 61 steel (No. 12) was defined as a relative molten corrosion rate factor. Namely, the smaller the relative molten corrosion rate factor, the more the test piece excels in the molten corrosion resistance. FIG. 3 shows the relative molten corrosion rate factor of each test piece, and it is evident that the steels of the invention excel in the molten corrosion resistance over any conventional and comparative steels. In particular, an extreme decline in the molten corrosion resistance is noted in the conventional steel (No. 13), i.e., Inconel 718.

Figure 4:
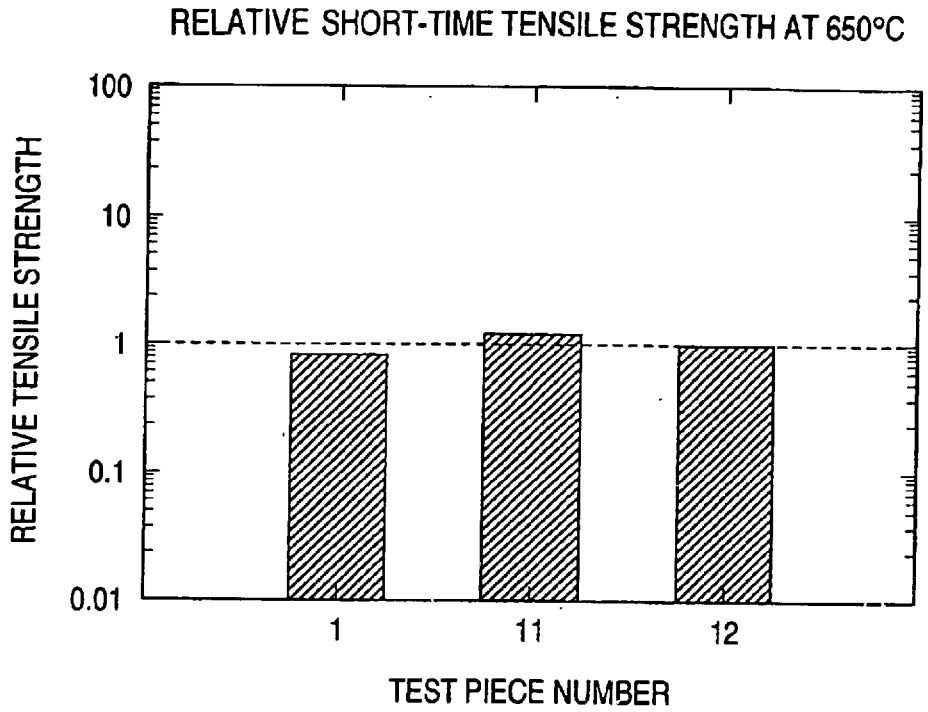
FIG. 4 is a graph illustrating the high-temperature, short-time tensile strength of some test pieces.
Figure 5:
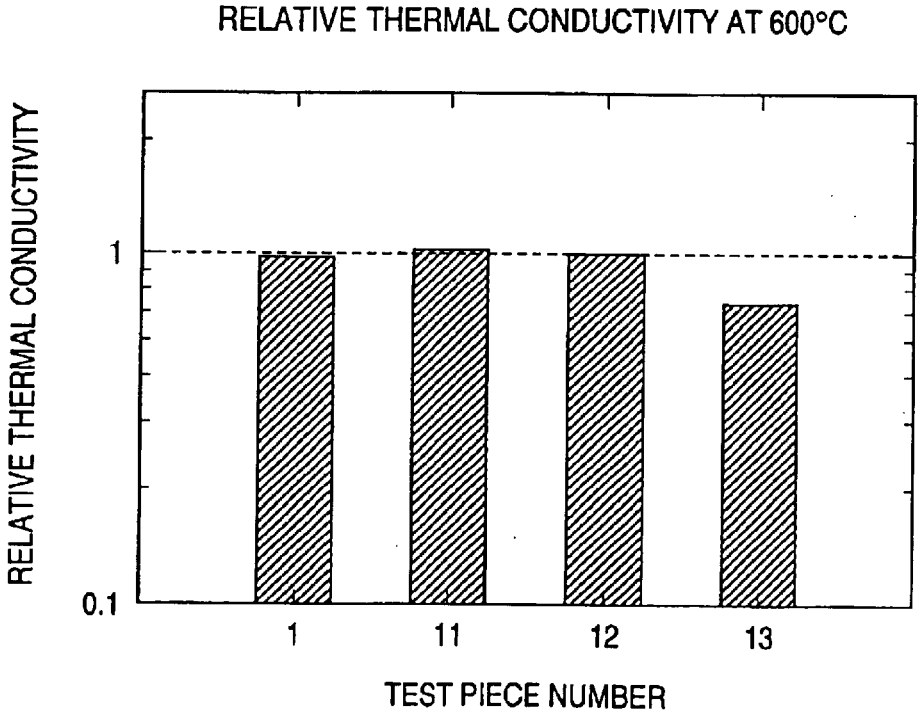
FIG. 5 is a graph illustrating the high-temperature thermal conductivity of some test pieces.

In addition, when the test pieces were held for a long time in a furnace of a high-temperature nitrogen atmosphere in the vicinity of 500° C., and the hardness of the surfaces after thermal conductivity at an elevate temperature (650° C.) were measured, and are shown in FIGS. 4 and 5 as relative values with respect to the conventional steel No. 12. As it is apparent from the figures, the steel of the invention has a short-time tensile property at elevated temperature equivalent to those of the conventional steels, and excels in the high-temperature thermal conductivity (with respect to the conventional steel No. 13).

As described above, in accordance with the invention, it is possible to provide a hot working die steel which excels in the molten corrosion resistance over an Ni-base superalloy such as Inconel 718, has a short-time tensile characteristic equivalent to that of JIS-SKD 61 steel, excels in the high-temperature creep characteristic over that steel, and is capable of suppressing the generation of thermal stresses due to the fact that it has satisfactory thermal conductivity. Accordingly, in cases where the steel of the invention is used as a structural member for a casting machine, a structural member for an injection molding machine, and a member for a hot forging machine, the life of the relevant member can be prolonged remarkably, so that the steel of the invention is very useful for industrial purposes.

What is claimed is:

1. A hot working die steel excelling in molten corrosion resistance and strength at elevated temperature comprising: 0.05–0.10% by mass of C, 0.04% by mass or less of Si, 0.07% by mass or less of Mn, 1.0% by mass or less of Ni, 5.0 to 13.0% by mass of Cr, 2.0% by mass or less of Mo, 1.0 to 8.0% by mass of W, 1.0 to 10.0% by mass of Co, 0.003 to 0.020% by mass of B, 0.005 to 0.050% by mass of N, and the balance including Fe and unavoidable impurities.

2. The hot working die steel excelling in molten corrosion resistance and strength at elevated temperature according to claim 1, further comprising 0.01 to 1.0% by mass of V as a constituent.

3. The hot working die steel excelling in molten corrosion resistance and strength at elevated temperature according to claim 1, further comprising by mass percent 0.01 to 1.0% by mass of at least one kind selected from Nb and Ta as a constituent.

4. The hot working die steel excelling in molten corrosion resistance and strength at elevated temperature according to claim 1, wherein the total content of Co and W is 5.0% by mass or more.

5. The hot working die steel excelling in molten corrosion resistance and strength at elevated temperature according to claim 1, wherein a value of a Cr equivalent expressed by the following formula is 7.0 or less:

Cr equivalent=[Cr %]+6[Si %]+4[Mo %]+1.5[W %]+11[V %]+5[Nb %]−40[C %]−2[Mn %]−4[Ni %]−30[N %]−2[Co %].

6. The hot working die steel excelling in molten corrosion resistance and strength at elevated temperature according to claim 2, wherein a value of a Cr equivalent expressed by the following formula is 7.0 or less:

Cr equivalent=[Cr %]+6[Si %]+4[Mo %]+1.5[W %]+11[V %]+5[Nb %]−40[C %]−2[Mn %]−4[Ni %]−30[N %]−2[Co %].

7. The hot working die steel excelling in molten corrosion resistance and strength at elevated temperature according to claim 3, wherein a value of a Cr equivalent expressed by the following formula is 7.0 or less:

Cr equivalent=[Cr %]+6[Si %]+4[Mo %]+1.5[W %]+11[V %]+5[Nb %]−40[C %]−2[Mn %]−4[Ni %]−30[N %]−2[Co %].

8. The hot working die steel excelling in molten corrosion resistance and strength at elevated temperature according to claim 4, wherein a value of a Cr equivalent expressed by the following formula is 7.0 or less:

Cr equivalent=[Cr %]+6[Si %]+4[Mo %]+1.5[W %]+11[V %]+5[Nb %]−40[C %]−2[Mn %]−4[Ni %]−30[N %]−2[Co %].

9. A member for high temperature use formed of a hot working die steel according to claim 1, wherein the member constitutes a structural member for a casting machine, a structural member for an injection molding machine, or a member for a hot forging machine.

10. The member for high temperature use formed of a hot working die steel according to claim 9, wherein surface hardening is performed at least for a portion of surfaces of the member.

11. The member for high temperature use formed of a hot working die steel according to claim 10, wherein said surface hardening is effected by one of nitriding, carbonization, and ion implantation.

* * * * *